US008384749B2

(12) United States Patent
Morooka et al.

(10) Patent No.: US 8,384,749 B2
(45) Date of Patent: Feb. 26, 2013

(54) THERMAL HEAD, PRINTER, AND MANUFACTURING METHOD FOR THE THERMAL HEAD

(75) Inventors: Toshimitsu Morooka, Chiba (JP); Keitaro Koroishi, Chiba (JP); Noriyoshi Shoji, Chiba (JP); Norimitsu Sanbongi, Chiba (JP)

(73) Assignee: Seiko Instruments Inc. (JP)

( * ) Notice: Subject to any disclaimer, the term of this patent is extended or adjusted under 35 U.S.C. 154(b) by 49 days.

(21) Appl. No.: 12/932,125

(22) Filed: Feb. 17, 2011

(65) Prior Publication Data

US 2011/0216147 A1 Sep. 8, 2011

(30) Foreign Application Priority Data

Mar. 8, 2010 (JP) ..... 2010-050450

(51) Int. Cl.
*B41J 2/335* (2006.01)

(52) U.S. Cl. ..... 347/200; 347/202

(58) Field of Classification Search ..... 347/200, 347/202; 29/611; 216/27
See application file for complete search history.

(56) References Cited

U.S. PATENT DOCUMENTS

| | | | | |
|---|---|---|---|---|
| 7,768,541 | B2 * | 8/2010 | Koroishi et al. | 347/202 |
| 8,144,175 | B2 * | 3/2012 | Koroishi et al. | 347/200 |
| 8,154,575 | B2 * | 4/2012 | Koroishi et al. | 347/207 |
| 8,189,021 | B2 * | 5/2012 | Morooka et al. | 347/206 |
| 2009/0102911 | A1 * | 4/2009 | Koroishi et al. | 347/206 |
| 2009/0102912 | A1 * | 4/2009 | Koroishi et al. | 347/206 |
| 2010/0118105 | A1 * | 5/2010 | Morooka et al. | 347/206 |
| 2011/0128340 | A1 * | 6/2011 | Morooka et al. | 347/200 |

FOREIGN PATENT DOCUMENTS

| | | | |
|---|---|---|---|
| EP | 2327554 | | 1/2011 |
| JP | 60006478 | | 1/1985 |
| JP | 4-250073 | * | 9/1992 |

* cited by examiner

*Primary Examiner* — Huan Tran
(74) *Attorney, Agent, or Firm* — Adams & Wilks

(57) ABSTRACT

A thermal head has a support substrate that has a concave portion having an opening portion formed in a surface of the support substrate, and an upper substrate bonded to the surface of the support substrate in a stacked state to close the opening portion. The upper substrate has an external dimension which is smaller than an external dimension of the support substrate and is slightly larger than an external dimension of the opening portion for closing the opening portion. A heating resistor is formed on a surface of the upper substrate in a position opposed to the concave portion of the support substrate. The thermal head is high in durability and reliability with increased printing efficiency as well as increased manufacturing yields.

18 Claims, 17 Drawing Sheets

THERMAL HEAD, PRINTER, AND MANUFACTURING METHOD FOR THE THERMAL HEAD

BACKGROUND OF THE INVENTION

1. Field of the Invention

The present invention relates to a thermal head, a printer, and a manufacturing method for the thermal head.

2. Description of the Related Art

There has been conventionally known a thermal head for use in thermal printers, which performs printing on a thermal recording medium by selectively driving a plurality of heating resistor elements based on printing data (see, for example, Japanese Patent Application Laid-open No. 2009-119850). In the thermal head disclosed in Japanese Patent Application Laid-open No. 2009-119850, an upper substrate is bonded to a support substrate having a concave portion so as to close the concave portion, to thereby form a cavity portion between the upper substrate and the support substrate, and heating resistors are disposed on the surface of the upper substrate in positions opposed to the cavity portion. In the thermal head, the cavity portion functions as a heat-insulating layer of low thermal conductivity to reduce an amount of heat to be transferred from the heating resistors toward the support substrate, to thereby increase thermal efficiency and reduce power consumption.

However, if a bonding failure part (void) is generated in a bonding surface between the upper substrate and the support substrate due to air confined therein or fine particles, the upper substrate may be broken or peel off because of its small thickness during the use in a printer, leading to a problem of decreased reliability. Further, such a void is responsible for lowering manufacturing yields. Besides, thermal printers require lower driving voltage and power saving aimed at long-term use, and hence the thermal head is expected to have much increased printing efficiency.

SUMMARY OF THE INVENTION

The present invention has been made in view of the above-mentioned circumstances, and it is therefore an object of the present invention to provide a thermal head that is high in durability and reliability with increased printing efficiency as well as increased manufacturing yields, and also provide a printer including the thermal head and a manufacturing method for the thermal head.

In order to achieve the above-mentioned object, the present invention provides the following measures.

The present invention provides a thermal head including: a support substrate including a concave portion having an opening portion formed in a surface of the support substrate; an upper substrate having an external dimension which is smaller than an external dimension of the support substrate and is slightly larger than an external dimension of the opening portion, for closing the opening portion when bonded to the surface of the support substrate in a stacked state; and a heating resistor formed on a surface of the upper substrate in a position opposed to the concave portion.

In the thermal head according to the present invention, the upper substrate having the heating resistor formed on the surface thereof functions as a heat storage layer. Further, the opening portion of the concave portion in the support substrate is closed by the upper substrate to form a cavity portion between the upper substrate and the support substrate. The cavity portion is disposed in the position opposed to the heating resistor and accordingly functions as a hollow heat-insulating layer for insulating heat generated by the heating resistor. Therefore, from the heat generated by the heating resistor, the amount of heat to be transferred toward the support substrate via the upper substrate may be reduced to increase the amount of heat to be transferred to the region above heating resistor to be utilized for printing and the like, to thereby increase thermal efficiency.

In this case, the external dimension of the upper substrate is smaller than the external dimension of the support substrate and slightly larger than that of the opening portion of the concave portion, which may reduce a capacity of heat to be accumulated in the upper substrate. Further, the heating resistor formed on the upper substrate protrudes in a stacking direction with respect to a region of the surface of the support substrate not covered by the upper substrate. Accordingly, the heating resistor may be brought into contact with a thermal recording medium more securely so that higher contact pressure is obtained. Therefore, printing efficiency may be increased.

Further, the reduced area of a bonding portion between the upper substrate and the support substrate contributes to suppressing the generation of voids due to air confined therein or fine particles, even when the upper substrate and the support substrate are directly bonded to each other by thermal fusion or the like. Therefore, manufacturing yields as well as the durability and reliability may be increased.

In the thermal head according to the present invention, the upper substrate may include: a flat top surface formed on an opposite side of a bonding surface to the support substrate; and side surfaces inclined outward, from an outer periphery of the flat top surface, as approaching the surface of the support substrate.

With such a structure, the upper substrate may receive a load of a platen roller over the top surface, to thereby prevent load concentration on a part of the upper substrate. Further, the side surfaces are inclined outward, from the outer periphery of the top surface, as approaching the surface of the support substrate, which facilitates the formation of the heating resistor on the upper substrate from the top surface along the side surfaces thereof.

Further, in the thermal head according to the present invention, the support substrate may include step portions defined along a perimeter of the opening portion and protruding in a stacking direction.

With such a structure, steps defined between the heating resistor, which is formed on the upper substrate, and the region of the surface of the support substrate not covered by the upper substrate are increased in height correspondingly to the step portions, to thereby further increase the contact pressure between the thermal recording medium and the heating resistor. Besides, the thickness of the upper substrate may be reduced to enhance a heat insulating effect, to thereby increase the printing efficiency.

Still further, in the thermal head according to the present invention, the thermal head may further include a pair of electrodes connected to both ends of the heating resistor, and the upper substrate may further include a convex portion formed in the surface of the upper substrate positioned between the pair of electrodes, the convex portion protruding in a stacking direction with the heating resistor.

With such a structure, when the pair of electrodes are applied with a voltage, a region (heating portion) of the heating resistor between the electrodes generates heat. In this case, because of the convex portion of the upper substrate, the heating portion of the heating resistor has a shape protruding in the stacking direction, specifically, a direction away from the concave portion of the support substrate. Accordingly, the steps between the heating portion and the electrodes may be reduced in height.

Therefore, it is possible to reduce the air layer, which is formed, when the thermal recording medium is brought into contact with the heating portion, between the heating portion and the thermal recording medium because of the steps with the electrodes, so that the heat generated by the heating portion may be transferred to the thermal recording medium efficiently. Therefore, the printing efficiency may be increased. Note that, the convex portion of the upper substrate is preferred to allow the heating portion of the heating resistor to protrude in the stacking direction with respect to the electrodes. Such a structure may eliminate the air layer to be formed between the heating portion and the thermal recording medium so that the surface of the thermal head is brought into intimate contact with the thermal recording medium.

Still further, in the thermal head according to the present invention, the convex portion may be formed inside a region opposed to the concave portion.

With such a structure, a part of the upper substrate which is thin because the convex portion is not formed may be disposed inside the region opposed to the cavity portion, to thereby reduce loss of heat that dissipates to the upper substrate, to increase the thermal efficiency.

Still further, in the thermal head according to the present invention, the convex portion may extend beyond the region opposed to the concave portion.

With such a structure, the convex portion contributes to an increased thickness of the upper substrate in the region opposed to the cavity portion, to thereby enhance the strength of the upper substrate.

Still further, in the thermal head according to the present invention, the thermal head may further include an adhesive layer disposed between the support substrate and the upper substrate, for adhering the support substrate and the upper substrate to each other.

With such a structure, even if the support substrate and the upper substrate employ inexpensive substrates high in surface roughness, the support substrate and the upper substrate may be bonded to each other at high accuracy through the adhesive layer so as to reduce voids due to air confined therein. Further, compared with the case of direct bonding between the upper substrate and the support substrate by thermal fusion or the like, a low heating temperature is allowed during the bonding. Note that, the adhesive layer may employ, for example, a resin or the like.

The present invention further provides a printer including: the thermal head according to the present invention described above; and a pressure mechanism for feeding a thermal recording medium while pressing the thermal recording medium against the heating resistor of the thermal head.

According to the present invention, because the thermal head high in durability and reliability with superior thermal efficiency is used, a failure of the printer to be caused by the damage of the upper substrate may be prevented, to thereby enhance the device reliability. Further, the heat generated by the heating resistor may be transferred with high efficiency to the thermal recording medium being pressed by the pressure mechanism so that power consumption during printing on the thermal recording medium may be reduced, to thereby extend battery duration.

The present invention further provides a manufacturing method for a thermal head, including: a bonding step of bonding, in a stacked state to a flat plate-shaped support substrate including a concave portion opened in a surface of the flat plate-shaped support substrate, an upper substrate having an external dimension which is smaller than an external dimension of the flat plate-shaped support substrate and is slightly larger than an external dimension of the concave portion, so as to close the concave portion; and a resistor forming step of forming a heating resistor on a surface of the upper substrate bonded to the flat plate-shaped support substrate in the bonding step, in a position opposed to the concave portion.

According to the present invention, in the bonding step, the upper substrate having the external dimension which is smaller than the external dimension of the support substrate and is slightly larger than that of the concave portion is bonded to the surface of the support substrate, to thereby manufacture a thermal head high in thermal efficiency, in which a heat capacity of the upper substrate functioning as a heat storage layer is reduced. Further, in the resistor forming step, the heating resistor is formed on the upper substrate so as to protrude in a stacking direction with respect to a region of the surface of the support substrate not covered by the upper substrate, to thereby obtain high contact pressure between a thermal recording medium and the heating resistor. Therefore, a thermal head with high printing efficiency may be manufactured.

Further, even when the upper substrate and the support substrate are directly bonded to each other by thermal fusion or the like, compared with the case of bonding the upper substrate to the entire surface of the support substrate, it is possible to suppress the generation of voids in a bonding portion between the upper substrate and the support substrate, to thereby manufacture a thermal head with increased manufacturing yields as well as increased durability and reliability. Note that, in the bonding step, the upper substrate and the support substrate may be directly bonded to each other by thermal fusion or the like, or alternatively an adhesive layer may be provided between the upper substrate and the support substrate so as to obtain adhesive bonding.

The present invention still further provides a manufacturing method for a thermal head, including: a bonding step of bonding a flat plate-shaped upper substrate in a stacked state to a flat plate-shaped support substrate including a concave portion opened in a surface of the flat plate-shaped support substrate, so as to close the concave portion; a thinning step of thinning the plate-shaped upper substrate bonded to the flat plate-shaped support substrate; a shaping step of removing portions outside a closing portion of the plate-shaped upper substrate for closing the concave portion while leaving the closing portion; and a resistor forming step of forming a heating resistor on a surface of the flat plate-shaped upper substrate thinned in the thinning step and shaped in the shaping step, in a position opposed to the concave portion.

According to the present invention, in the bonding step, an upper substrate which is thick enough to be easily manufactured and handled may be used, and in the thinning step, the upper substrate may be formed on the surface of the support substrate at a desired small thickness. Further, in the shaping step, the portions of the upper substrate outside the closing portion for the concave portion are removed, and accordingly the upper substrate protruding in the stacking direction may be formed on a part of the surface of the support substrate.

Therefore, the upper substrate may be reduced in external dimension to reduce a heat capacity as a heat storage layer, and high contact pressure between a thermal recording medium and the heating resistor may be obtained. Besides, even if voids are generated in a bonding portion between the upper substrate and the support substrate, such voids may be removed. Therefore, it is possible to manufacture a thermal head high in printing efficiency with increased durability and reliability as well as increased manufacturing yields.

In the manufacturing method according to the present invention, the shaping step may include removing a region of the surface of the flat plate-shaped support substrate not covered by the flat plate-shaped upper substrate, to a given thickness.

With such a structure, it is possible to manufacture a thermal head in which steps defined between the heating resistor, which is formed on the upper substrate, and the region of the surface of the support substrate not covered by the upper substrate are increased in height so that high contact pressure is obtained between the thermal recording medium and the heating resistor.

The present invention provides effects of increasing printing efficiency as well as increasing durability and reliability and manufacturing yields.

BRIEF DESCRIPTION OF THE DRAWINGS

In the accompanying drawings:

FIGS. 5A to 5G are vertical cross-sectional views, in which FIG. 5A illustrates a concave portion forming step; FIG. 5B, a bonding step; FIG. 5C, a thinning step; FIG. 5D, a shaping step; FIG. 5E, a resistor forming step; FIG. 5F, an electrode portion forming step; and FIG. 5G, a protective film forming step;

DETAILED DESCRIPTION OF THE PREFERRED EMBODIMENTS

First Embodiment

Now, a thermal head, a printer, and a manufacturing method for a thermal head according to a first embodiment of the present invention are described below with reference to the accompanying drawings.

Figure 1:
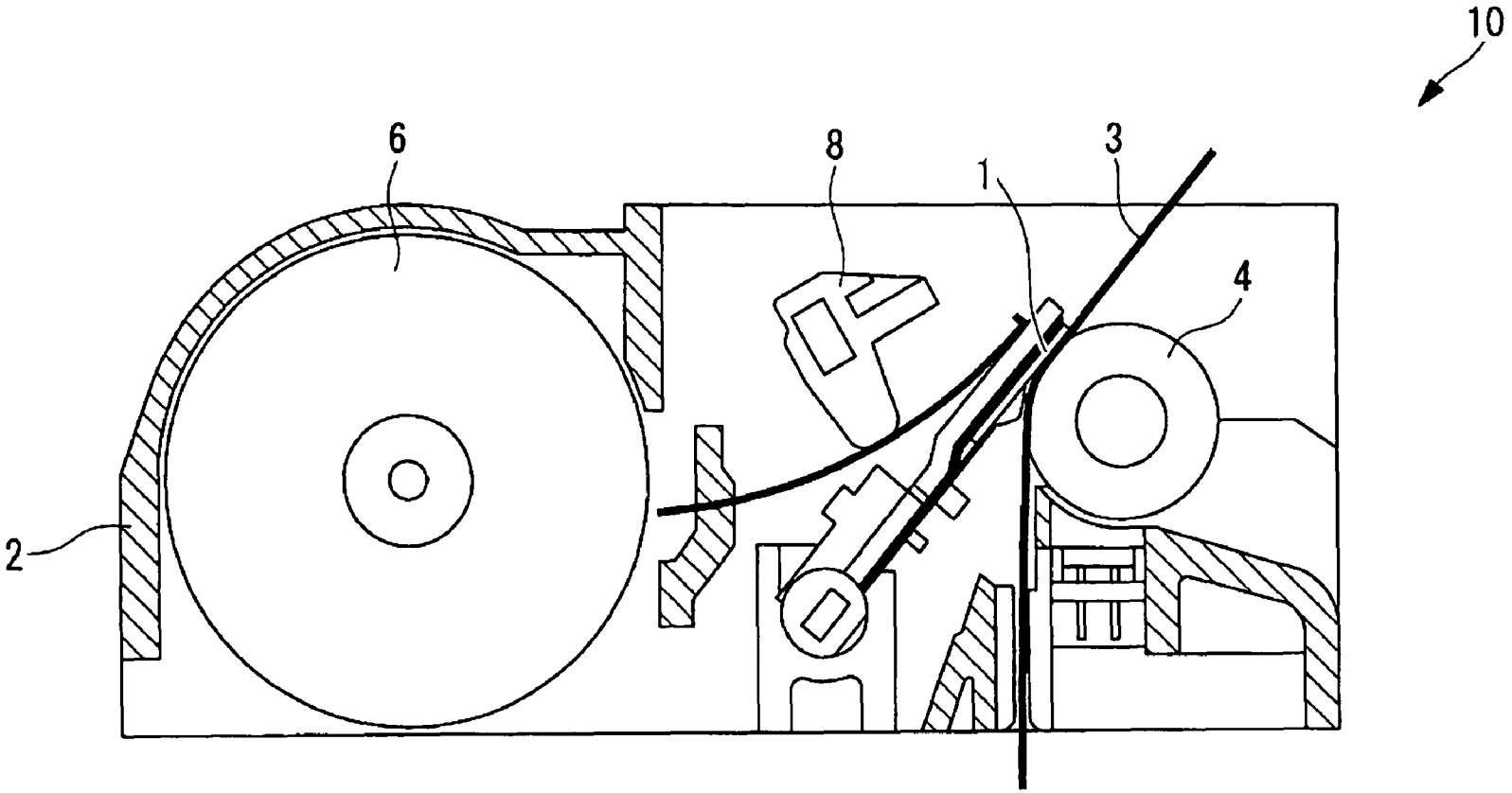
FIG. 1 is a schematic structural view of a thermal printer according to a first embodiment of the present invention.

As illustrated in FIG. 1, a thermal printer (printer) 10 according to this embodiment includes a main body frame 2, a platen roller 4 disposed horizontally, a thermal head 1 disposed so as to be opposed to an outer peripheral surface of the platen roller 4, a paper feeding mechanism 6 for feeding an object to be printed, such as thermal paper (thermal recording medium) 3, between the platen roller 4 and the thermal head 1, and a pressure mechanism 8 for pressing the thermal head 1 against the thermal paper 3 with a predetermined pressing force.

Against the platen roller 4, the thermal head 1 and the thermal paper 3 are pressed by the operation of the pressure mechanism 8. Accordingly, a load of the platen roller 4 is applied to the thermal head 1 via the thermal paper 3.

Figure 2:
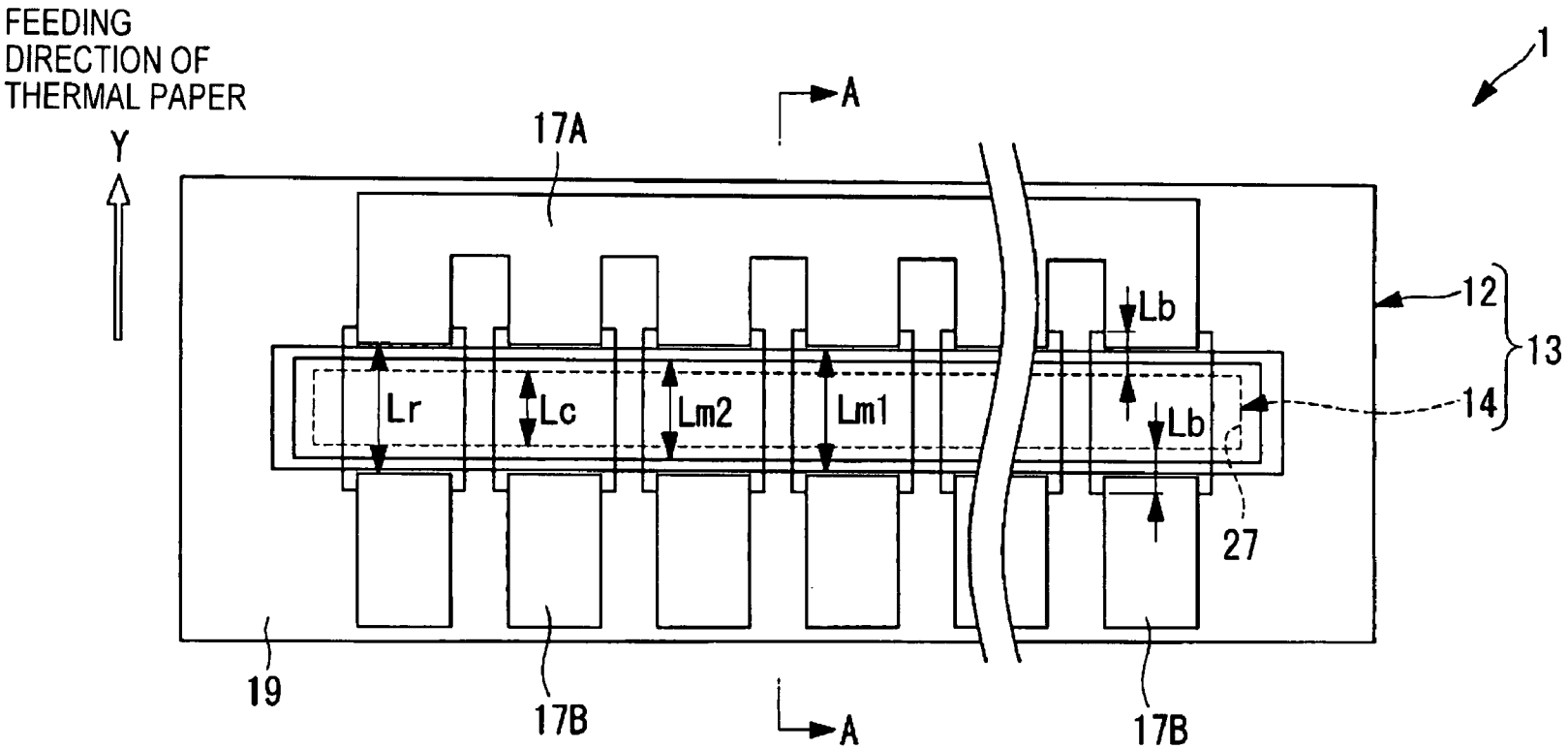
FIG. 2 is a plan view of a thermal head of FIG. 1 viewed in a stacking direction from a protective film side.
Figure 3:
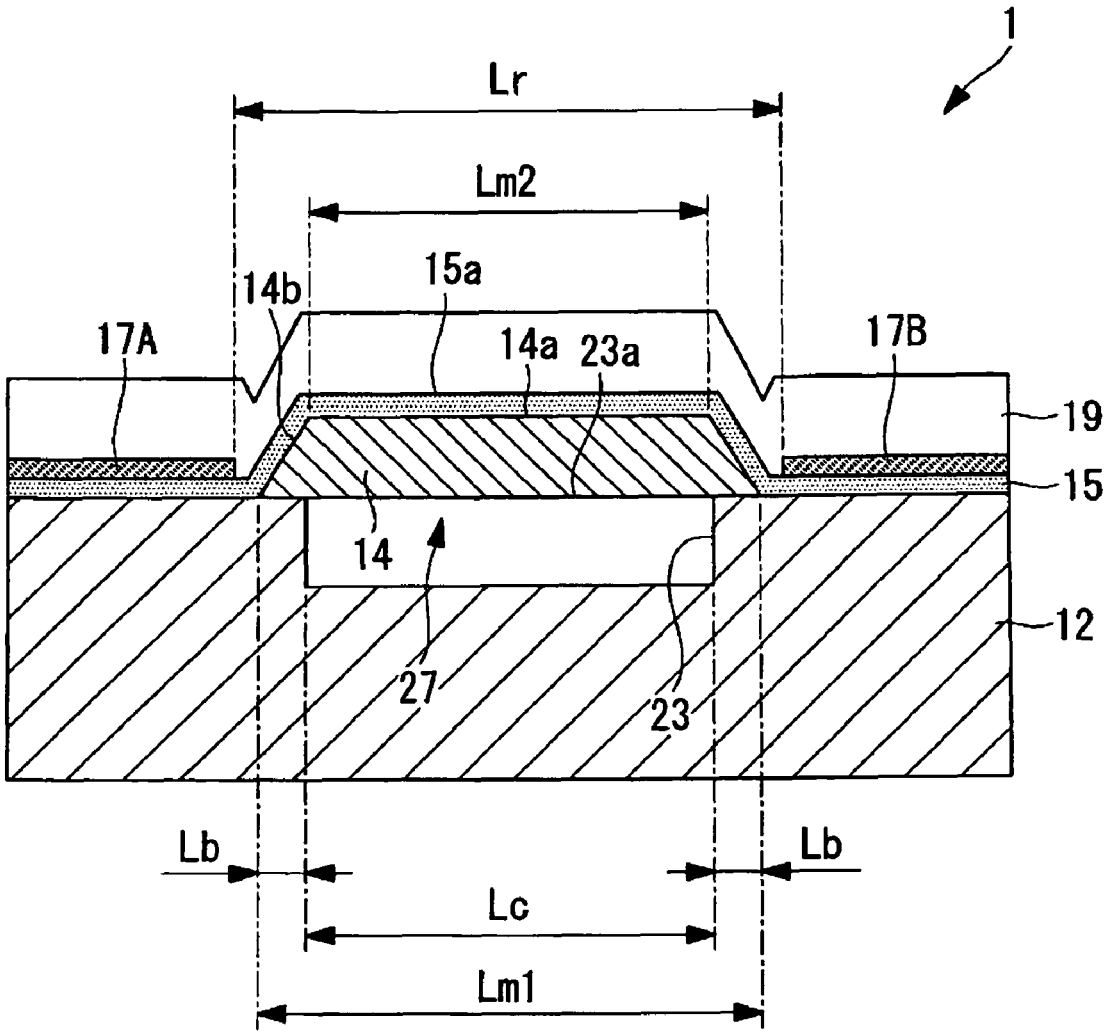
FIG. 3 is a cross-sectional view of the thermal head taken along the line A-A of FIG. 2.

As illustrated in FIGS. 2 and 3, the thermal head 1 includes a substrate main body 13, a plurality of heating resistors 15 provided on the substrate main body 13, pairs of electrode portions 17A and 17B connected to both ends of the heating resistors 15 on the substrate main body 13, and a protective film 19 covering a surface of the substrate main body 13 in part, the heating resistors 15, and the electrode portions 17A and 17B. In the drawings, the arrow Y represents a feeding direction of the thermal paper 3 by the platen roller 4.

The substrate main body 13 is fixed to a heat dissipation plate (not shown) as a plate-shaped member made of a metal such as aluminum, a resin, ceramics, glass, or the like, to thereby dissipate heat via the heat dissipation plate. The substrate main body 13 includes a flat plate-shaped support substrate 12 that is fixed to the heat dissipation plate, and a substantially flat plate-shaped upper substrate 14 that is bonded to a surface of the support substrate 12 in a stacked state.

The support substrate 12 is, for example, an insulating substrate such as a glass substrate or a ceramic substrate having a thickness approximately ranging from 300 μm to 1 mm. In the support substrate 12, there is formed a concave portion 23 having an opening portion (opening) 23*a* at a bonding surface to the upper substrate 14, i.e., the opening 23*a* of the concave portion 23 opens at the surface of the support substrate 12 that is bonded to the upper substrate 14. The concave portion 23 is formed into a rectangular shape extending along the longitudinal direction of the support substrate 12.

The upper substrate 14 is a glass substrate of a substantially rectangular shape with a thickness approximately ranging from 10 μm to 100 μm. For the upper substrate 14 and the support substrate 12, it is desired to use glass substrates made of the same material or substrates having similar properties. The upper substrate 14 has a width dimension which is smaller than a width dimension of the support substrate 12 and is slightly larger than a width dimension (Lc) of the concave portion 23. The upper substrate 14 is disposed to close the opening portion 23*a* of the concave portion 23.

Specifically, in the upper substrate 14, the bonding surface to the support substrate 12 has a width dimension (Lml) slightly larger than the width dimension (Lc) of the opening portion 23*a*. It is desired that each width dimension (Lb) of regions (bonding regions) of the bonding surface of the upper substrate 14 which are outside the opening portion 23*a* in its width direction be equal to or smaller than the width dimension (Lc) of the concave portion 23.

The upper substrate 14 has a flat top surface 14*a* on the opposite side of the bonding surface to the support substrate 12. Further, the upper substrate 14 has side surfaces 14*b* inclined outward, from the outer periphery of the top surface 14*a*, as approaching the surface of the support substrate 12. In other words, the upper substrate 14 has a shape in which a width dimension (Lm2) of the top surface 14*a* is smaller than the width dimension (Lm1) of the bonding surface. The upper substrate 14 is formed to be larger in height than the electrode portions 17A and 17B.

The plurality of heating resistors 15 are formed in the width direction of the upper substrate 14 so as to cover the top surface 14*a* and both the side surfaces 14*b* of the upper substrate 14. The upper substrate 14 is provided with the heating resistors 15 on the surface thereof to function as a heat storage layer for storing part of heat generated by the heating resistors 15.

The heating resistors 15 are formed along both the side surfaces 14*b* and the top surface 14*a* of the upper substrate 14 from the surface of the support substrate 12, so as to straddle the concave portion 23 of the support substrate 12 in its width direction. The plurality of heating resistors 15 are arrayed at predetermined intervals along the longitudinal direction of the upper substrate 14 (longitudinal direction of the concave portion 23 of the support substrate 12).

The heating resistors 15 are each connected to the electrode portions 17A and 17B at both end portions thereof positioned on the surface of the support substrate 12. The heating resistor 15 has a heating region corresponding to a portion positioned between the electrode portions 17A and 17B, that is, a portion positioned substantially directly above the concave portion 23. Hereinafter, the heating region of the heating resistor 15 is referred to as heating portion 15*a*.

The electrode portions 17A and 17B supply the heating resistors 15 with power to allow the heating portions 15*a* to generate heat. The electrode portions 17A and 17B include a common electrode 17A connected to one end of each of the heating resistors 15 in the longitudinal direction, and a plurality of individual electrodes 17B connected to another end of each of the heating resistors 15. The common electrode 17A is integrally connected to all the heating resistors 15, and the individual electrodes 17B are connected to the heating resistors 15 individually.

The protective film 19 protects the heating resistors 15 and the electrode portions 17A and 17B from abrasion and corrosion. The protective film 19 has a surface shape with projections and depressions formed along step portions defined by the upper substrate 14 and the electrode portions 17A and 17B. In the surface of the protective film 19, a portion (portion to serve as a printing portion) covering the heating portion 15*a* of the heating resistor 15 has a convex shape protruding in the stacking direction with respect to the surface of the support substrate 12 and the rest covering the electrode portions 17A and 17B.

In the thermal head 1 structured as described above, the opening portion 23*a* of the concave portion 23 in the support substrate 12 is closed by the upper substrate 14, to thereby form a cavity portion 27 directly under the upper substrate 14, specifically, directly under the heating portion 15*a* of the heating resistor 15. The cavity portion 27 has a communication structure opposed to all the heating resistors 15, and functions as a hollow heat-insulating layer for preventing heat generated by the heating portions 15*a* from being transferred toward the support substrate 12 via the upper substrate 14.

Next, a manufacturing method for the thermal head 1 structured in this way is described.

The manufacturing method for the thermal head 1 according to this embodiment includes a step of forming the substrate main body 13 and a step of forming the heating resistors 15 and the like on the substrate main body 13. The step of forming the substrate main body 13 includes a concave portion forming step SA1 of forming the concave portion 23 in the support substrate 12, a bonding step SA2 of bonding the support substrate 12 and the upper substrate 14 to each other, a thinning step SA3 of thinning the upper substrate 14, and a shaping step SA4 of shaping the upper substrate 14. The step of forming the heating resistors 15 and the like includes a resistor forming step SA5 of forming the heating resistors 15 on the substrate main body 13, an electrode portion forming step SA6 of forming the electrode portions 17A and 17B, and a protective film forming step SA7 of forming the protective film 19.

Figure 4:
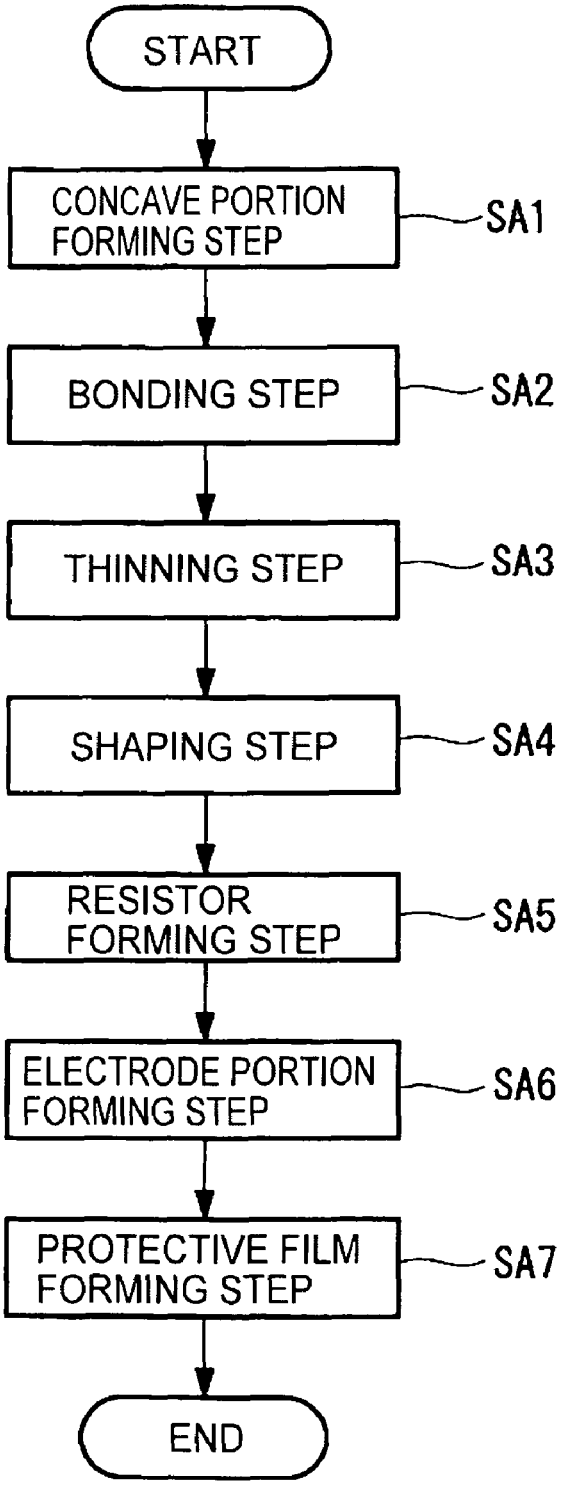
FIG. 4 is a flowchart illustrating a manufacturing method for the thermal head according to the first embodiment of the present invention.

Hereinafter, the respective steps are specifically described with reference to a flowchart of FIG. 4.

Figure 5A:
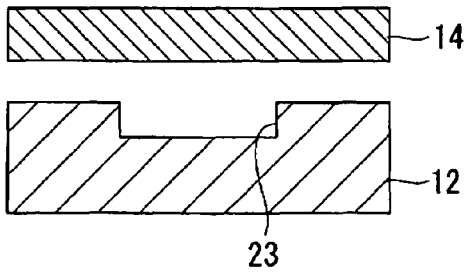

First, in the concave portion forming step SA1, as illustrated in FIG. 5A, the concave portion 23 is formed in the surface of the flat plate-shaped support substrate 12 in a position to be opposed to the heating resistors 15, which are to be formed in the resistor forming step SA5. The concave portion 23 is formed in a given surface of the support substrate 12 by, for example, sandblasting, dry etching, wet etching, or laser machining.

Figure 5B:
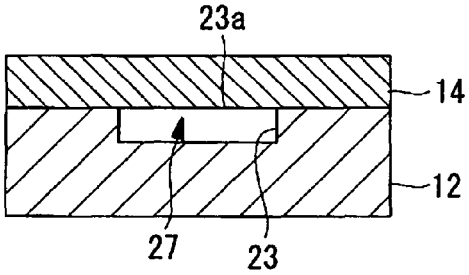

Subsequently, in the bonding step SA2, as illustrated in FIG. 5B, the flat plate-shaped thin glass plate (upper substrate) 14 with a thickness of, for example, 100 μm or more is bonded to the surface of the support substrate 12 having the opening portion 23*a*. The opening portion 23*a* of the concave portion 23 is covered by the upper substrate 14, to thereby form the cavity portion 27 between the support substrate 12 and the upper substrate 14. The thickness of the cavity portion 27 is defined by the depth of the concave portion 23, which makes it easy to control the thickness of the cavity portion 27 serving as the hollow heat-insulating layer.

An example of the bonding method is direct bonding by thermal fusion between the support substrate 12 and the upper substrate 14. For example, the support substrate 12 and the upper substrate 14 are bonded to each other at room temperature and then subjected to thermal fusion at high temperature. The resultant may be sufficiently high in bonding strength. Note that, it is desired that the bonding be performed at the softening temperature or lower in order to prevent deformation of the upper substrate 14.

In this step, even if voids are generated in the vicinity of the concave portion 23 due to air confined therein, the voids may be removed by moving the air confined in the bonding portion between the support substrate 12 and the upper substrate 14, to the concave portion 23. Therefore, it is possible to reduce the voids in the bonding region around the opening portion 23*a* of the concave portion 23.

Figure 5C:
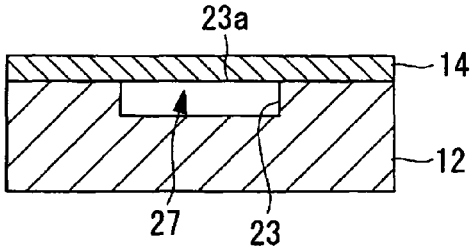

Subsequently, in the thinning step SA3, as illustrated in FIG. 5C, the upper substrate 14 is thinned by etching, polishing, or the like so as to have a desired small thickness. Further, the top surface 14*a* of the upper substrate 14 is formed into a flat shape. Available methods of thinning the upper substrate 14 are various types of etching, which are employed for forming the concave portion 23 in the concave portion forming step SA1. An available method of polishing the upper substrate 14 is, for example, chemical polishing (CMP), which is used for high-precise polishing of semiconductor wafers or the like.

Here, as to the upper substrate 14, it is difficult to manufacture and handle a substrate having a thickness of 100 μm or less, and such a substrate is expensive. Thus, instead of directly bonding an originally thin upper substrate 14 onto the support substrate 12 in the bonding step SA2, the upper substrate 14 which is thick enough to be easily manufactured and handled is bonded onto the support substrate 12, and then the upper substrate 14 is thinned in the thinning step SA3. This enables a very thin upper substrate 14 to be formed on the surface of the support substrate 12 with ease at low cost.

Figure 5D:
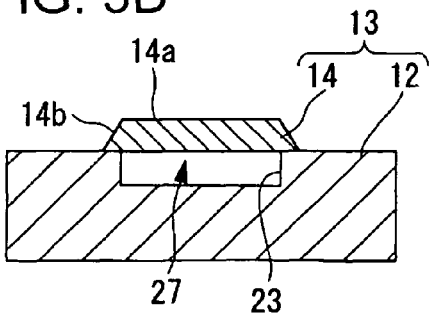

Subsequently, in the shaping step SA4, as illustrated in FIG. 5D, a closing portion of the upper substrate 14 for closing the opening portion 23*a* of the support substrate 12 is left while portions outside the closing portion are removed. In this case, the side surfaces 14*b* of the upper substrate 14 are each formed into a shape inclined outward, from the outer periphery of the top surface 14*a*, as approaching the surface of the support substrate 12. The shaping of the upper substrate 14 is performed by, for example, dry etching, wet etching, or the like, on the surface of the upper substrate 14.

In this step, the upper substrate 14 is formed to have an external dimension which is smaller than an external dimension of the support substrate 12 and is slightly larger than that of the concave portion 23, to thereby reduce an area of the bonding portion between the support substrate 12 and the upper substrate 14 to reduce voids. Further, the width dimension (Lb) of the bonding region between the support substrate 12 and the upper substrate 14 is made equal to or smaller than the width dimension (Lc) of the concave portion 23, to thereby reduce the voids to a minimum.

Through the above-mentioned steps, the substrate main body 13 is formed, in which the upper substrate 14 of a convex shape is disposed in a stacked state on a part of the surface of the support substrate 12, specifically, directly above the cavity portion 27 in the surface of the support substrate 12.

Figure 5E:
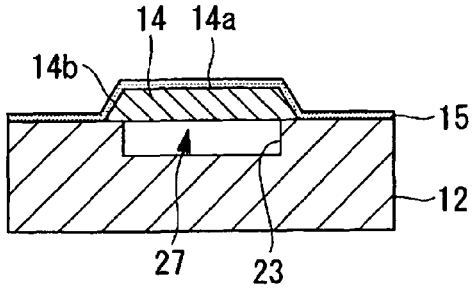
Figure 5F:
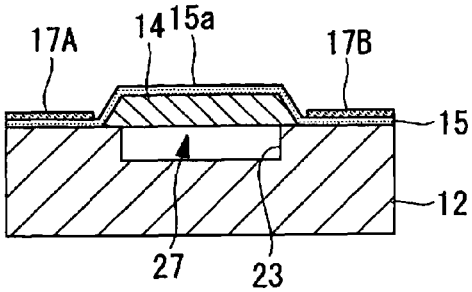
Figure 5G:
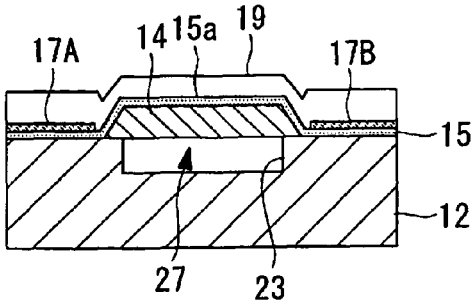

Next, in the resistor forming step SA5, as illustrated in FIG. 5E, the plurality of heating resistors 15 are formed so as to cover the support substrate 12 in part and partially cover the top surface 14*a* and the side surfaces 14*b* of the upper substrate 14. Subsequently, in the electrode portion forming step SA6, as illustrated in FIG. 5F, the common electrode 17A and the individual electrodes 17B are connected to both ends of the heating resistors 15, respectively. Then, in the protective film forming step SA7, as illustrated in FIG. 5G, the protective film 19 is formed so as to cover the upper substrate 14, the heating resistors 15, and the electrode portions 17A and 17B disposed over the surface of the support substrate 12.

The resistor forming step SA5, the electrode portion forming step SA6, and the protective film forming step SA7 may respectively employ the same methods as in a conventional manufacturing method for a thermal head to form the heating resistors 15, the electrode portions 17A and 17B, and the protective film 19.

Through the above-mentioned steps, the thermal head 1 is completed, in which the printing portion of the surface of the protective film 19 covering the heating portions 15*a* of the heating resistors 15 protrudes in the stacking direction with respect to the surface of the support substrate 12 and the rest of the surface of the protective film 19 covering the electrode portions 17A and 17B.

Hereinafter, operations of the thermal head 1 structured in this way and the thermal printer 10 is described.

In printing on the thermal paper 3 using the thermal printer 10 according to this embodiment, first, a voltage is selectively applied to the individual electrodes 17B of the thermal head 1. Then, a current flows through the heating resistors 15 which are connected to the selected individual electrodes 17B and the common electrode 17A opposed thereto, to thereby allow the heating portions 15*a* of the heating resistors 15 to generate heat.

In this case, in the thermal head 1, the cavity portion 27 functions as the hollow heat-insulating layer so that, from the heat generated by the heating portions 15*a*, the amount of heat to be transferred toward the support substrate 12 via the upper substrate 14 may be reduced to increase the amount of heat to be transferred to the region above the heating resistors 15 to be utilized for printing and the like. Accordingly, thermal efficiency may be increased. Besides, the upper substrate 14 is slightly larger in size than the opening portion 23*a*of the concave portion 23, which may reduce a capacity of heat to be accumulated in the upper substrate 14.

Subsequently, the pressure mechanism 8 is operated to press the thermal head 1 against the thermal paper 3 being fed by the platen roller 4. The platen roller 4 rotates about an axis parallel to the array direction of the heating resistors 15, to thereby feed the thermal paper 3 toward the Y direction orthogonal to the array direction of the heating resistors 15. Against the thermal paper 3, the printing portion of the surface of the protective film 19 covering the heating portions 15*a* of the heating resistors 15 is pressed, so that color is developed on the thermal paper 3, to thereby perform printing.

In this case, the printing portion of the surface of the protective film 19 covering the heating portions 15*a* is formed into a convex shape protruding in the stacking direction with respect to the rest of the surface of the protective film 19, and hence the printing portion is brought into contact with the thermal paper 3 more securely so that higher contact pressure is obtained. Therefore, printing efficiency may be increased.

Further, because of a small area of the bonding portion between the support substrate 12 and the upper substrate 14, the thermal head 1 is high in durability and reliability with little defects such as voids. Therefore, it is possible to prevent a failure due to the damage of the upper substrate 14 from being caused, to thereby increase the reliability of the thermal printer 10. Besides, the heat generated by the heating portions 15*a* may be transferred with high efficiency to the thermal paper 3 so that power consumption during printing may be reduced, to thereby extend battery duration.

Figure 6:
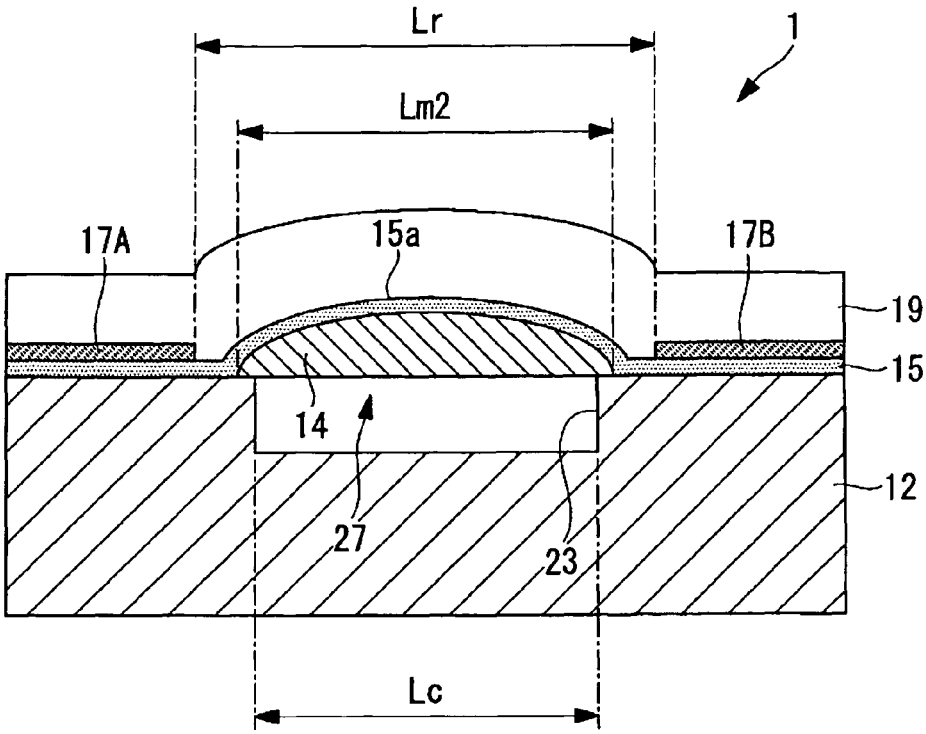
FIG. 6 is a cross-sectional view illustrating an upper substrate, which is formed into a semi-cylindrical shape, of a thermal head according to a modified example of the first embodiment of the present invention.

Note that, in this embodiment, the upper substrate 14 has the flat top surface 14*a*, but as an alternative thereto, for example, as illustrated in FIG. 6, the upper substrate 14 may have a surface formed in a semi-cylindrical shape, or in a bowl shape, on the opposite side of the bonding surface. In such a case, similarly to the shape of the upper substrate 14, the heating resistors 15 and the protective film 19 may be formed into a semi-cylindrical shape or a bowl shape. Such a shape also contributes to increased thermal efficiency.

Further, in this embodiment, the upper substrate 14 is thinned and shaped in the thinning step SA3 and the shaping step SA4, respectively, but as an alternative thereto, the thinning step SA3 or the shaping step SA4 may be omitted by employing an upper substrate 14 which is thinned in advance to a desired small thickness or employing an upper substrate 14 which is formed in advance to have a desired thickness and shape.

Note that, the embodiment of the present invention may be modified as follows.

For example, in the embodiment of the present invention, the upper substrate 14 is thinned in the thinning step SA3 and then shaped in the shaping step SA4. However, as a first modified example, the order of the thinning step SA3 and the shaping step SA4 may be interchanged.

Figure 7A:
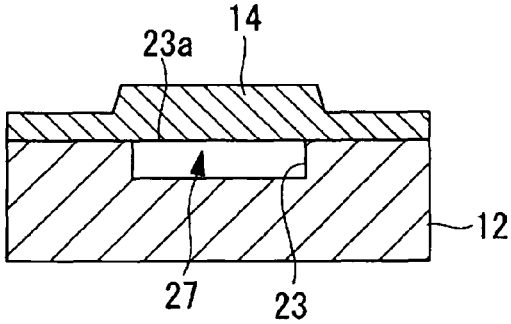
FIGS. 7A and 7B illustrate a shaping step and a thinning step, respectively, for a thermal head according to a first modified example of the first embodiment of the present invention.
Figure 7B:
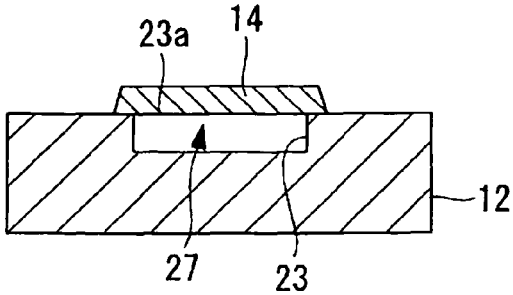

Specifically, as illustrated in FIG. 7A, the shaping step may be performed first, in which, in the upper substrate 14 before being thinned, portions outside a closing portion for closing the opening portion 23*a* of the support substrate 12 may be removed to a given thickness while leaving the closing portion, and after that, as illustrated in FIG. 7B, the thinning step may be performed, in which the upper substrate 14 may be thinned to a desired small thickness by wet etching. This allows the upper substrate 14 to be shaped in the shaping step in a state where the upper substrate 14 is thick enough to be easily processed. Further, because wet etching is used for the thinning, the convex shape of the upper substrate 14 shaped in the shaping step may be left unetched.

Figure 8:
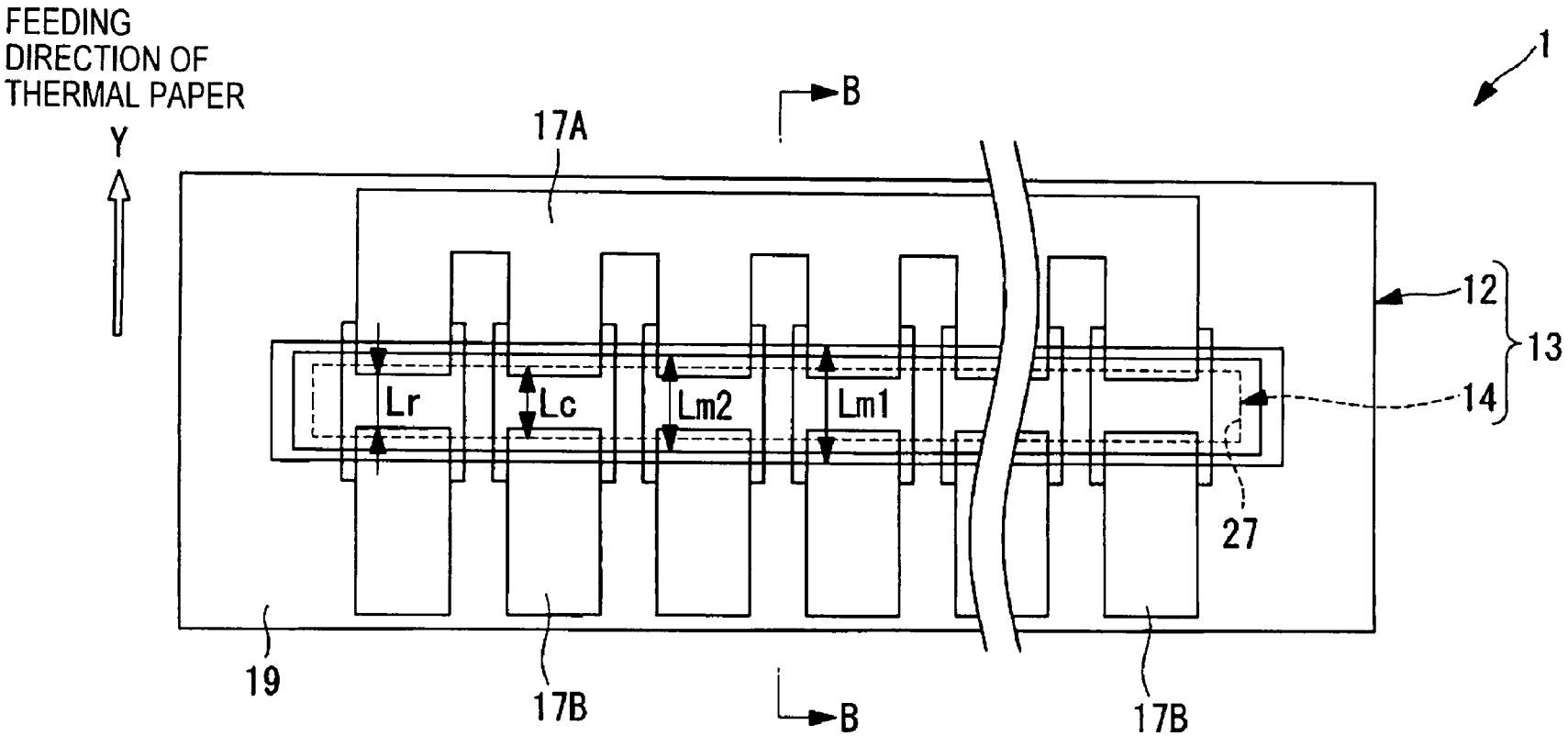
FIG. 8 is a plan view of a thermal head according to a second modified example of the first embodiment of the present invention viewed in the stacking direction from the protective film side.
Figure 9:
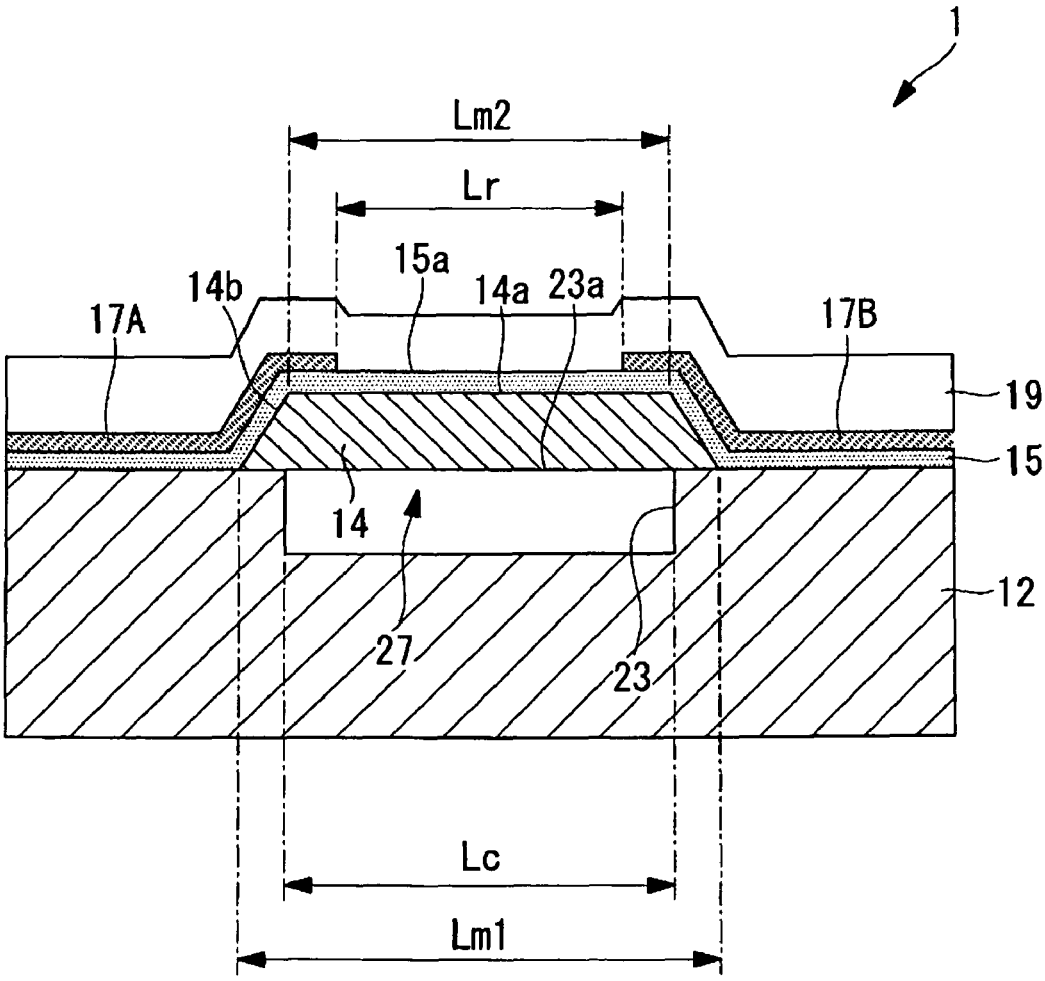
FIG. 9 is a cross-sectional view of the thermal head taken along the line B-B of FIG. 8.

Further, in the embodiment of the present invention, the electrode portions 17A and 17B are connected to both end portions of the heating resistors 15 positioned on the surface of the support substrate 12. However, as a second modified example, for example, as illustrated in FIGS. 8 and 9, the electrode portions 17A and 17B may be extended to the surface of the heating resistor 15 positioned on the top surface 14*a* of the upper substrate 14. In this case, the electrode portions 17A and 17B are disposed along the side surfaces 14*b* of the upper substrate 14.

With this structure, the heating portion 15*a* may be disposed inside a region opposed to the concave portion 23 with a reduced width dimension (Lr) between the electrode portions 17A and 17B, so as to provide the heating portion 15*a* on the top surface 14*a* of the upper substrate 14. Therefore, from the heat generated by the heating portions 15*a*, the amount of heat lost by being dissipated to the support substrate 12 may be reduced, to thereby increase thermal efficiency.

Figure 10:
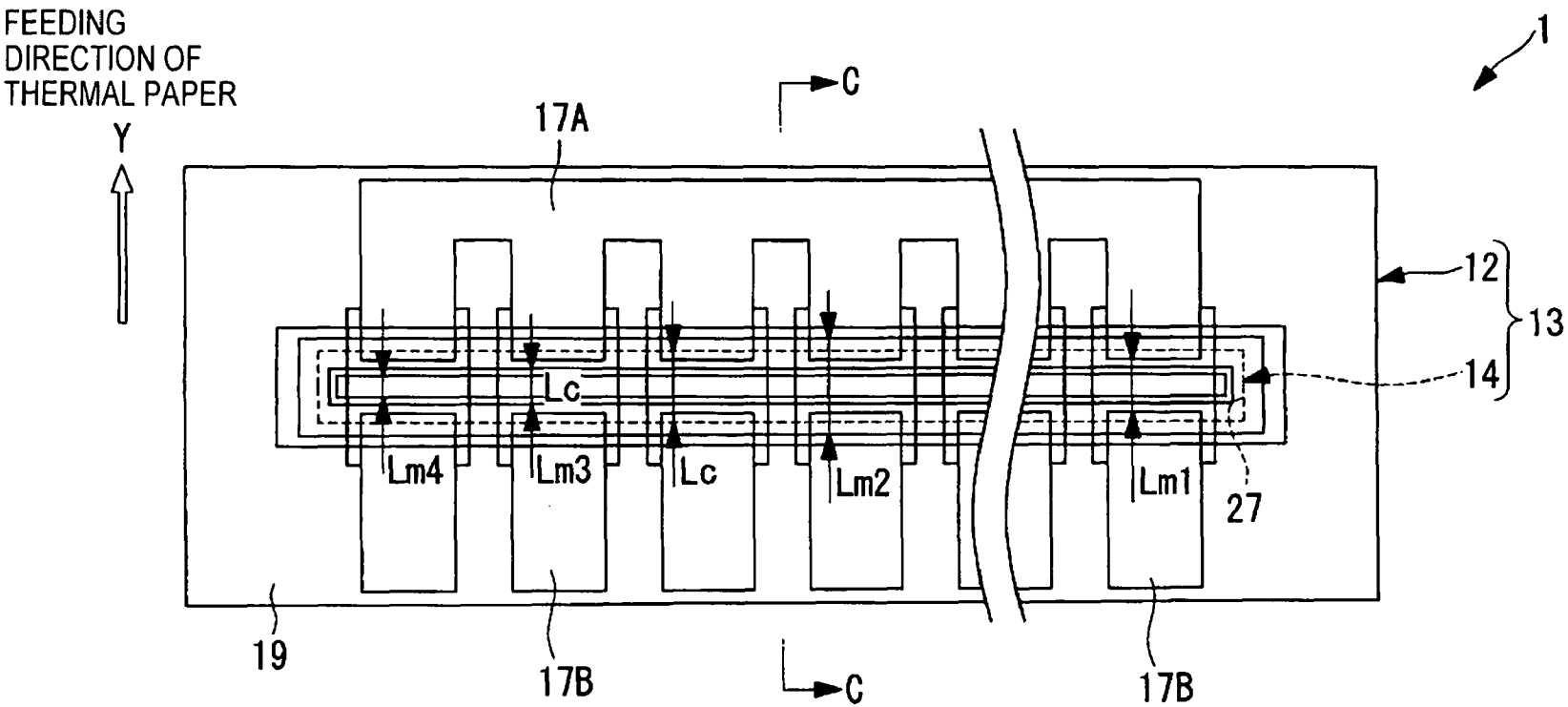
FIG. 10 is a plan view of a thermal head according to a third modified example of the first embodiment of the present invention viewed in the stacking direction from the protective film side.
Figure 11:
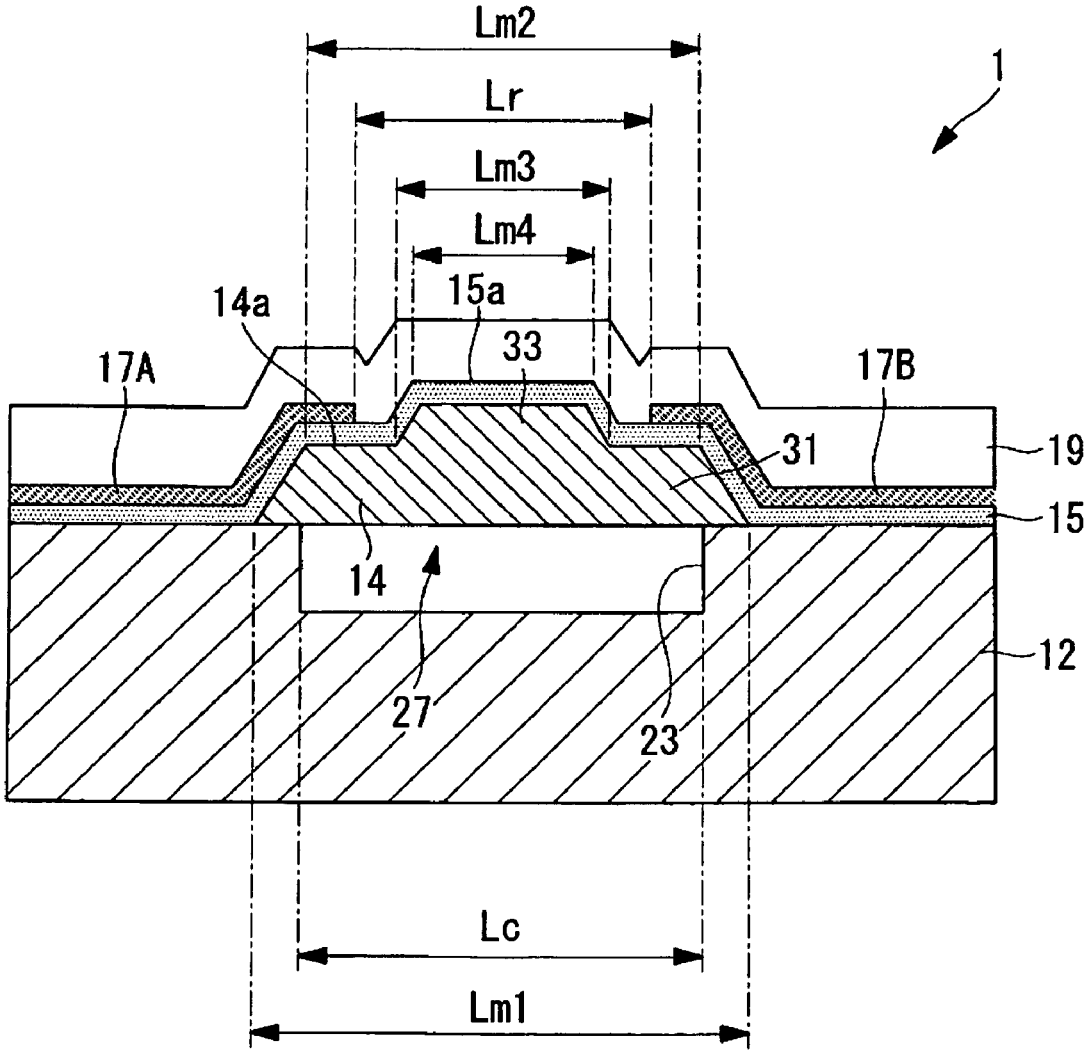
FIG. 11 is a cross-sectional view of the thermal head taken along the line C-C of FIG. 10.

As a third modified example, for example, as illustrated in FIGS. 10 and 11, the upper substrate 14 may have a convex portion 33 protruding from the top surface 14*a* in the stacking direction with the heating resistors 15. Hereinafter, the lower layer of the upper substrate 14 is referred to as first convex portion 31 and the upper layer of the upper substrate 14 is referred to as second convex portion 33.

In this case, in the second convex portion 33, a boundary-portion with the first convex portion 31 may have a width dimension (Lm3) smaller than the width dimension (Lm2) of the top surface 14*a* and the width dimension (Lr) between the electrode portions 17A and 17B, and a top portion may have a width dimension (Lm4) smaller than the width dimension (Lm3). The heating resistors 15 may be formed along the shapes of the first convex portion 31 and the second convex portion 33. The electrode portions 17A and 17B may be extended to the top surfaces 14*a* of the first convex portion 31. The protective film 19 may have a shape with projections and depressions along the shapes of the first convex portion 31 and the second convex portion 33.

With such a structure, because of the second convex portion 33, the heating portion 15*a* of the heating resistor 15 has a convex shape protruding in the stacking direction, specifically, a direction away from the cavity portion 27. Accordingly, the steps between the heating portion 15*a* and the electrode portions 17A and 17B may be reduced in height. Therefore, it is possible to reduce an air layer, which is formed, when the thermal paper 3 is brought into contact with the heating portion 15*a*, between the heating portion 15*a* and the thermal paper 3 because of the steps with the electrode portions 17A and 17B, so that the heat generated by the heating portion 15*a* may be transferred to the thermal paper 3 efficiently. Therefore, the printing efficiency may be increased.

Note that, the second convex portion 33 is preferred to allow the heating portion 15*a* of the heating resistor 15 to protrude in the stacking direction with respect to the electrode portions 17A and 17B. Such a structure may eliminate the air layer from being formed between the heating portion 15*a* and the thermal paper 3 so that the printing portion of the surface of the protective film 19 is brought into intimate contact with the thermal paper 3. Further, the second convex portion 33 is preferred to be disposed inside a region opposed to the cavity portion 27. With such a structure, a part of the upper substrate 14 where the second convex portion 33 is not. formed, that is, a part of the upper substrate 14 which has a thickness of only the first convex portion 31, may be disposed inside the region opposed to the cavity portion 27, to thereby reduce an amount of heat to be lost as being dissipated to the upper substrate 14, to thereby increase thermal efficiency.

Figure 12A:
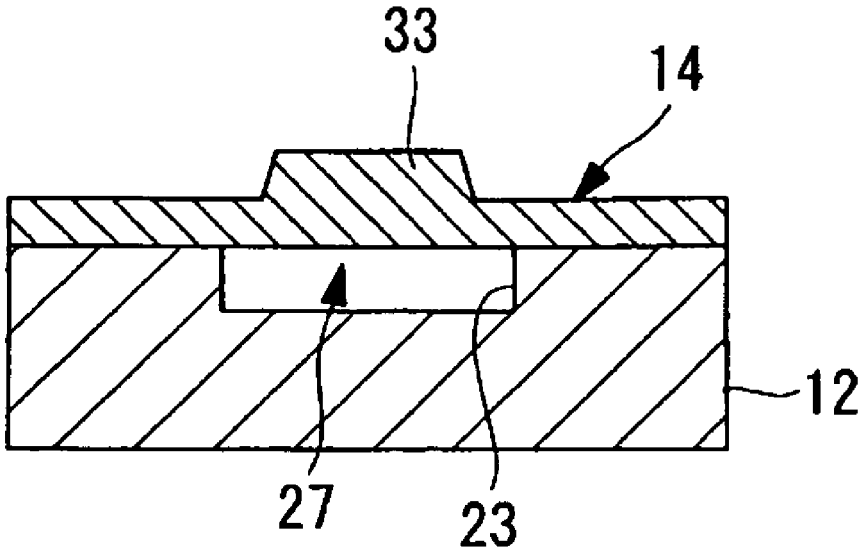
FIGS. 12A and 12B are vertical cross-sectional views illustrating a first shaping step and a second shaping step, respectively, according to the third modified example.

In a manufacturing method for a thermal head 1 according to this modified example, the shaping step may include a first shaping step of shaping the second convex portion 33 and a second shaping step of shaping the first convex portion 31. Specifically, in the first shaping step, as illustrated in FIG. 12A, a surface of the thin glass plate (upper substrate 14) thinned in the thinning step SA3 may be subjected to dry etching, wet etching, or the like so that the second convex portion 33 may be formed in a region directly above the cavity portion 27. A height of the second convex portion 33 is determined by the thickness of the electrode portions 17A and 17B formed in the electrode portion forming step SA6, and may be set to, for example, 0.5 μm to 3 μm.

Figure 12B:
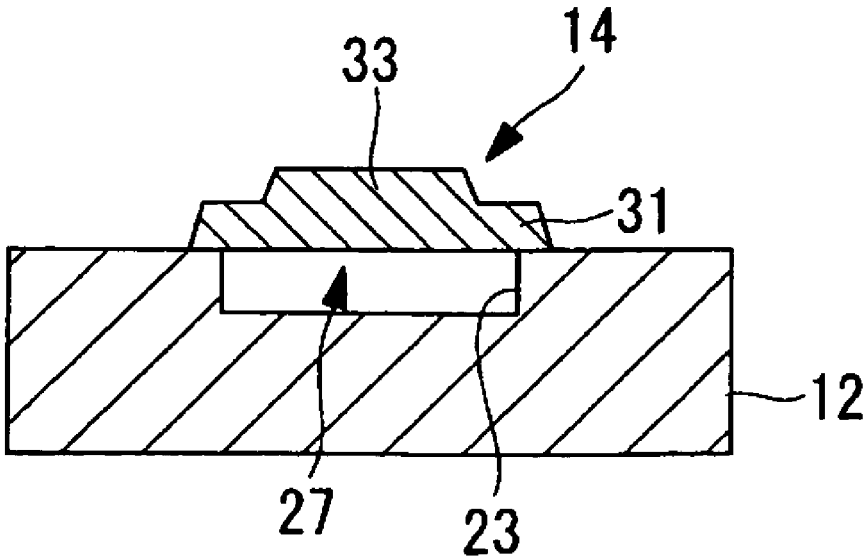

In the second shaping step, as illustrated in FIG. 12B, the upper substrate 14 may be subjected to dry etching, wet etching, or the like so that a closing portion of the first convex portion 31 for closing the concave portion 23 may be left while portions outside the closing portion may be removed.

Figure 13:
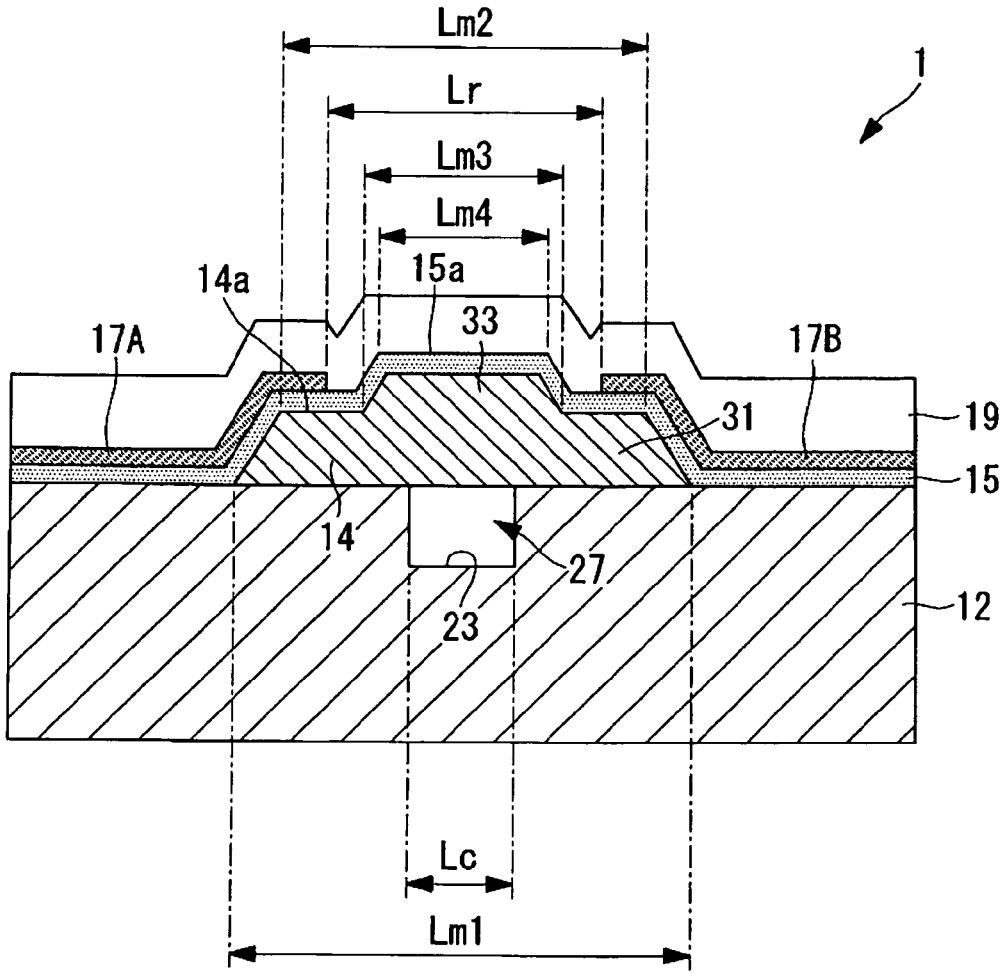
FIG. 13 illustrates another mode of the thermal head according to the third modified example.

Note that, in this modified example, the second convex portion 33 is formed inside the region opposed to the cavity portion 27, but, for example, as illustrated in FIG. 13, the second convex portion 33 may be formed to extend beyond the region opposed to the cavity portion 27. With such a structure, the second convex portion 33 contributes to an increased thickness of the upper substrate 14 in the region opposed to the cavity portion 27, to thereby enhance the strength of the upper substrate 14.

Figure 14:
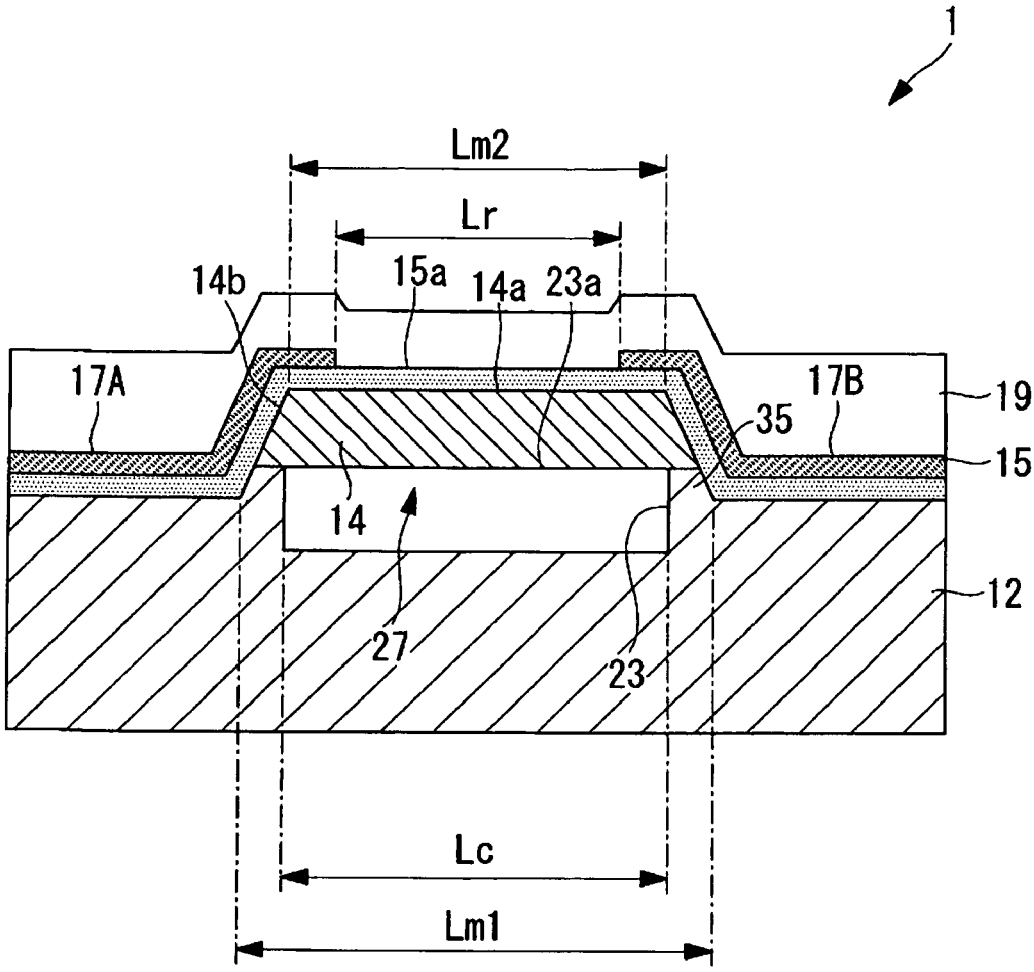
FIG. 14 is a vertical cross-sectional view of a thermal head according to a fourth modified example of the first embodiment of the present invention.

Further, as a fourth modified example, for example, as illustrated in FIG. 14, the support substrate 12 may have step portions 35 defined along the perimeter of the opening portion 23*a* and protruding in the staking direction. In other words, the support substrate 12 may be thin in part outside the bonding portion with the upper substrate 14. With such a structure, steps defined between the heating resistor 15, which is formed on the upper substrate 14, and the region of the surface of the support substrate 12 not covered by the upper substrate 14 may be increased in height correspondingly to the step portions 35, to thereby increase the contact pressure between the heating portion 15*a* and the thermal paper 3. Besides, the upper substrate 14 maybe reduced in thickness to enhance a heat insulating effect, to thereby increase the printing efficiency.

Figure 15:
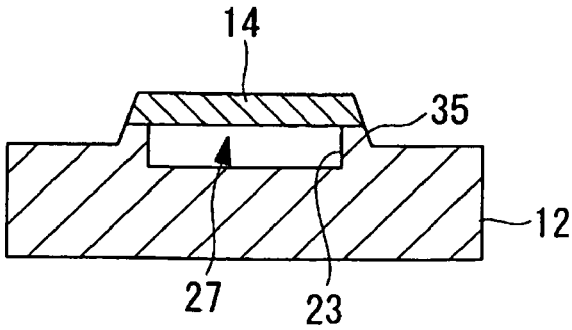
FIG. 15 is a vertical cross-sectional view illustrating a shaping step according to the fourth modified example.

In a manufacturing method for a thermal head 1 according to this modified example, as illustrated in FIG. 15, in the shaping step SA4, the portions of the upper substrate 14 outside the closing portion of closing the concave portion 23 of the support substrate 12 may be removed, and further the region of the surface of the support substrate 12 not covered by the upper substrate 14 may be partially removed to reduce the thickness.

In this case, it is preferred that the step portions 35 of the support substrate 12 have side surfaces which are flush with the side surfaces 14*b* of the upper substrate 14. This facilitates the formation of the heating resistors 15 along the side surfaces of the step portions 35 and the side surfaces 14*b* of the upper substrate 14. Further, it is desired that the support substrate 12 and the upper substrate 14 employ glass substrate of the same material and the support substrate 12 and the upper substrate 14 be directly bonded to each other without using an adhesive layer in the bonding step. This realizes the above-mentioned structure with ease.

Second Embodiment

Next, a thermal head, a printer, and a manufacturing method for a thermal head according to a second embodiment of the present invention are described.

Figure 16:
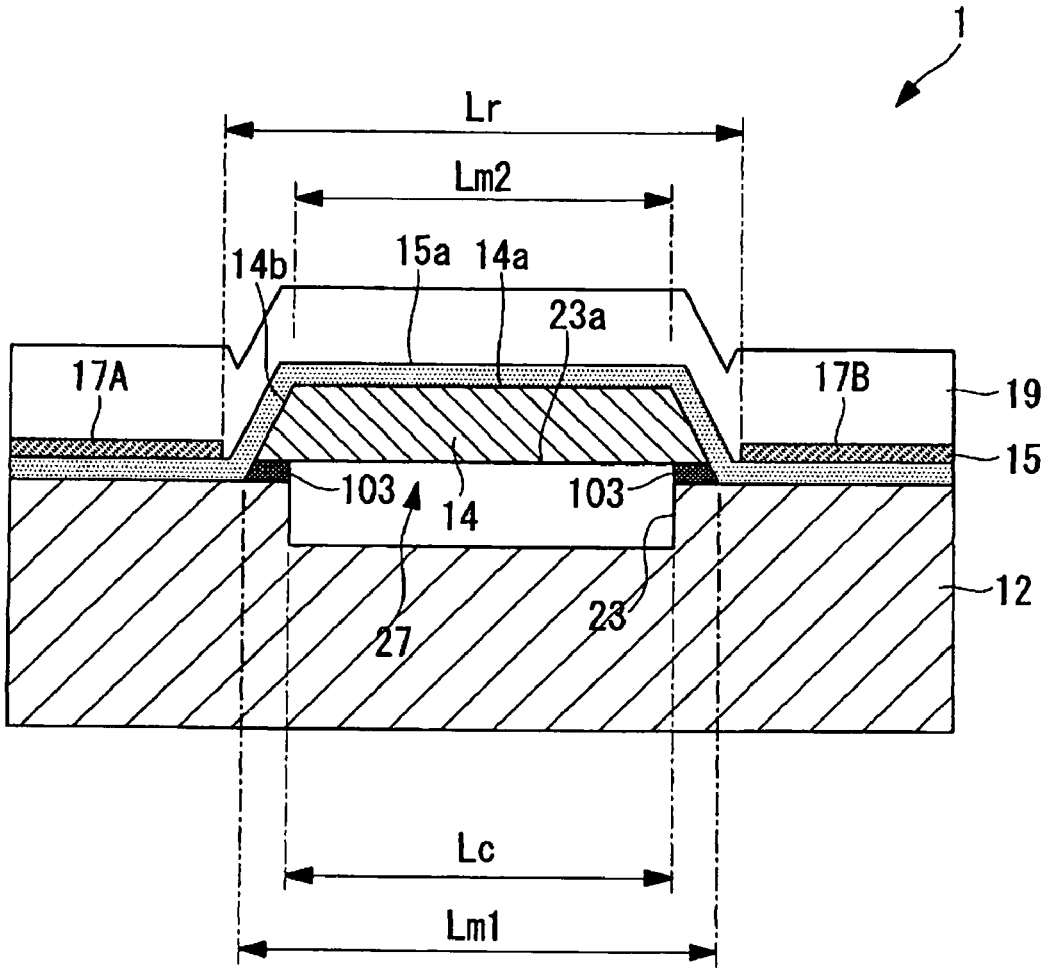
FIG. 16 is a vertical cross-sectional view of a thermal head according to a second embodiment of the present invention.

As illustrated in FIG. 16, a thermal head 101 according to this embodiment is different from the first embodiment in that the thermal head 101 further includes an adhesive layer 103 that is disposed between the support substrate 12 and the upper substrate 14 to adhere the support substrate 12 and the upper substrate 14 to each other.

Hereinafter, description common to that of the thermal head 1, the thermal printer 10, and the manufacturing method for a thermal head according to the first embodiment is omitted by using the same symbols.

The adhesive layer 103 is disposed in the bonding region between the support substrate 12 and the upper substrate 14, that is, in the vicinity of the opening portion 23*a* of the support substrate 12. When the thermal head 101 operates, the heating portion 15*a* of the heating resistor 15 increases in temperature to about 200° C. to 300° C., and hence an adhesive constituting the adhesive layer 103 is desired to use a high heat-resistant material capable of resisting the temperature of the heating portion 15*a*. Specifically, used herein as the adhesive layer 103 is one made from a polymeric resin material, such as a polyimide resin or an epoxy resin.

Here, in general, a material used for the protective film of the thermal head has significantly large internal stress. For example, an SiAlON film formed by sputtering has an internal stress (compressive stress) of −500 Mpa to −2,000 Mpa. Accordingly, strong tensile stress is applied to the upper substrate by the protective film. As a result, the upper substrate bonded by the adhesive layer of a resin with low rigidity cannot withstand the stress of the protective film, and accordingly cracks may be generated in the upper substrate. Further, the cracks thus generated may spread over the entire upper substrate. For example, as a reference example, in a case of a thermal head in which the upper substrate is bonded to the entire surface of the support substrate via the adhesive layer, there is high provability of generation of cracks in the upper substrate by external force, and the cracks may spread in most part of the region of the upper substrate.

According to the thermal head 101 of this embodiment, the bonding area between the support substrate 12 and the upper substrate 14 is limited to the perimeter of the opening portion 23*a* of the support substrate 12, to thereby suppress the generation of cracks in the upper substrate 14. Therefore, compared with the thermal head according to the reference example in which the upper substrate is bonded to the entire surface of the support substrate, both of high reliability and high durability may be attained.

Note that, the thermal head 101 according to this embodiment may be used in the thermal printer 10.

Next, a manufacturing method for the thermal head 101 structured in this way is described.

Figure 17:
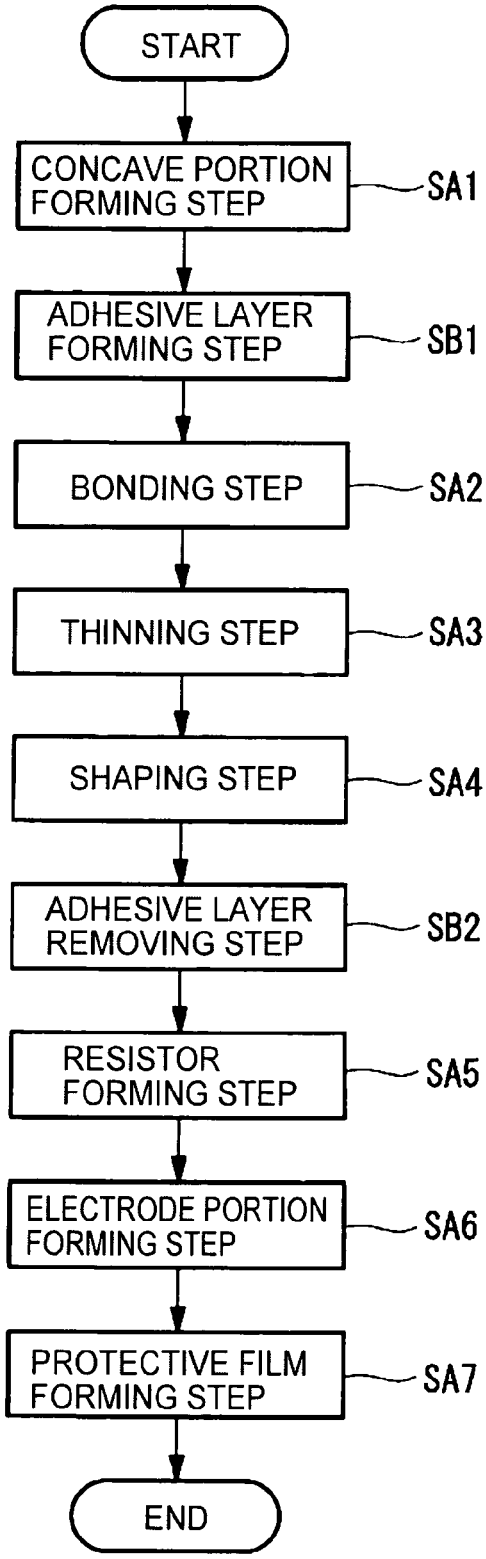
FIG. 17 is a flowchart illustrating a manufacturing method for the thermal head according to the second embodiment of the present invention.

As illustrated in a flowchart of FIG. 17, the manufacturing method for the thermal head 101 according to this embodiment includes an adhesive layer forming step SB1 between the concave portion forming step SA1 and the bonding step SA2, and an adhesive layer removing step SB2 of removing unnecessary part of the adhesive layer 103 after the shaping step SA4 is finished. Hereinafter, the respective steps are specifically described.

Figure 18A:
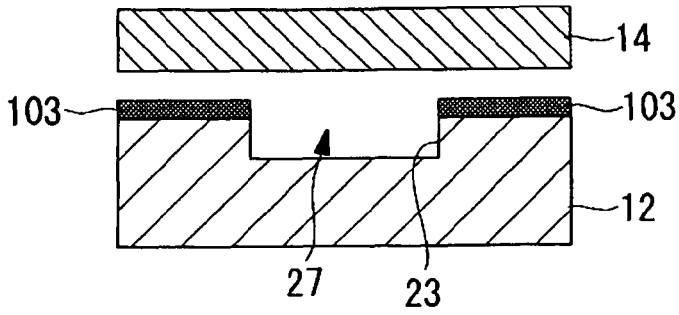
FIGS. 18A to 18D are vertical cross-sectional views illustrating an adhesive layer forming step, a bonding step, a shaping step, and an adhesive layer removing step according to the second embodiment, respectively.

In the adhesive layer forming step SB1, as illustrated in FIG. 18A, the adhesive layer 103 of a predetermined pattern is formed between the support substrate 12 and the thin glass plate (upper substrate 14). For example, an adhesive is applied onto the surface of the support substrate 12, and the adhesive layer 103 is formed by pattering using screen printing or photolithography.

Figure 18B:
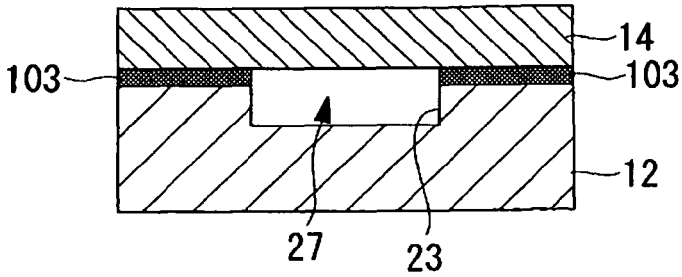

In the bonding step SA2, instead of direct bonding, as illustrated in FIG. 18B, the support substrate 12 and the upper substrate 14 are attached to each other via the adhesive layer 103 in the stacking direction so as to obtain adhesive bonding.

Figure 18C:
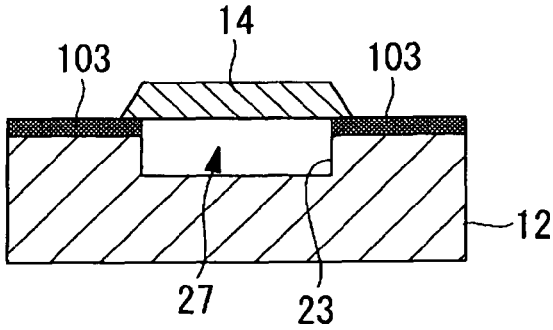

In the shaping step SA4, as illustrated in FIG. 18C, the adhesive layer 103 functions as an etching stop layer when the portions of the upper substrate 14 outside the closing portion are removed.

Figure 18D:
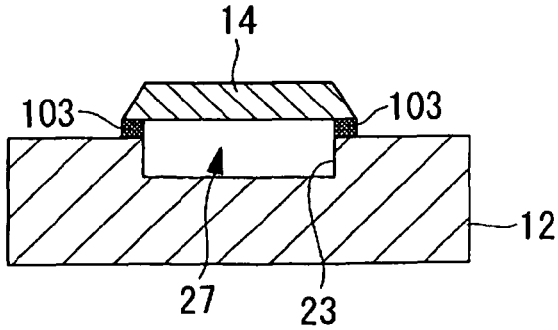

Subsequently, in the adhesive layer removing step SB2, as illustrated in FIG. 18D, the adhesive layer 103 exposed at the surface of the support substrate 12 is removed. Note that, a resin is an electrically insulating material and thus may be left unremoved. But, the resin is susceptible to the stress by the protective film 19, and accordingly an unnecessary adhesive layer 103 is removed in this embodiment.

Here, as a reference example, in a case of direct bonding between the support substrate and the upper substrate, the generation of voids are affected by the surface roughness of the support substrate and the upper substrate, and the number and the size of the voids are further increased as the surface roughness is higher. In order to prevent the generation of voids, it is preferred to suppress the surface roughness of the support substrate and the upper substrate to 1 nm or less.

According to the manufacturing method for the thermal head 101 of this embodiment, in the bonding step SA2, the support substrate 12 and the upper substrate 14 are bonded with the use of the adhesive layer 103 made of a resin or the like, and hence the generation of voids resulting from confined air may be prevented. Further, the support substrate 12 and the upper substrate 14 may employ inexpensive substrates with high surface roughness, and a low heating temperature is allowed during the bonding.

Further, as another reference example, in a case of a thermal head in which the upper substrate is bonded to the entire surface of the support substrate via the adhesive layer, a large number of cracks may be generated in end surfaces of the upper substrate during the dividing of elements by a dicer, a scriber, or the like.

According to the manufacturing method for the thermal head 101 of this embodiment, in the shaping step SA4, the upper substrate 14 is formed through wet etching or dry etching to have an external dimension smaller than that of the support substrate 12, to thereby prevent the generation of cracks in the end surfaces of the upper substrate 14. Therefore, it is possible to manufacture a thermal head 101 with high reliability and durability in which the generation of cracks in the upper substrate 14 due to the stress of the protective film 19 is prevented. Further, in the shaping step SA4, the adhesive layer 103 functions as the etching stop layer, to thereby allow the thickness of the upper substrate 14 to be controlled with ease.

Note that, this embodiment has described an exemplary method in which the shaping step SA4 is performed after the thinning step SA3, but, for example, the thinning step may be performed before the shaping step. In such a case, the adhesive layer removing step SB2 may be performed after the thinning step.

Further, the second embodiment may be modified as follows.

Figure 19:
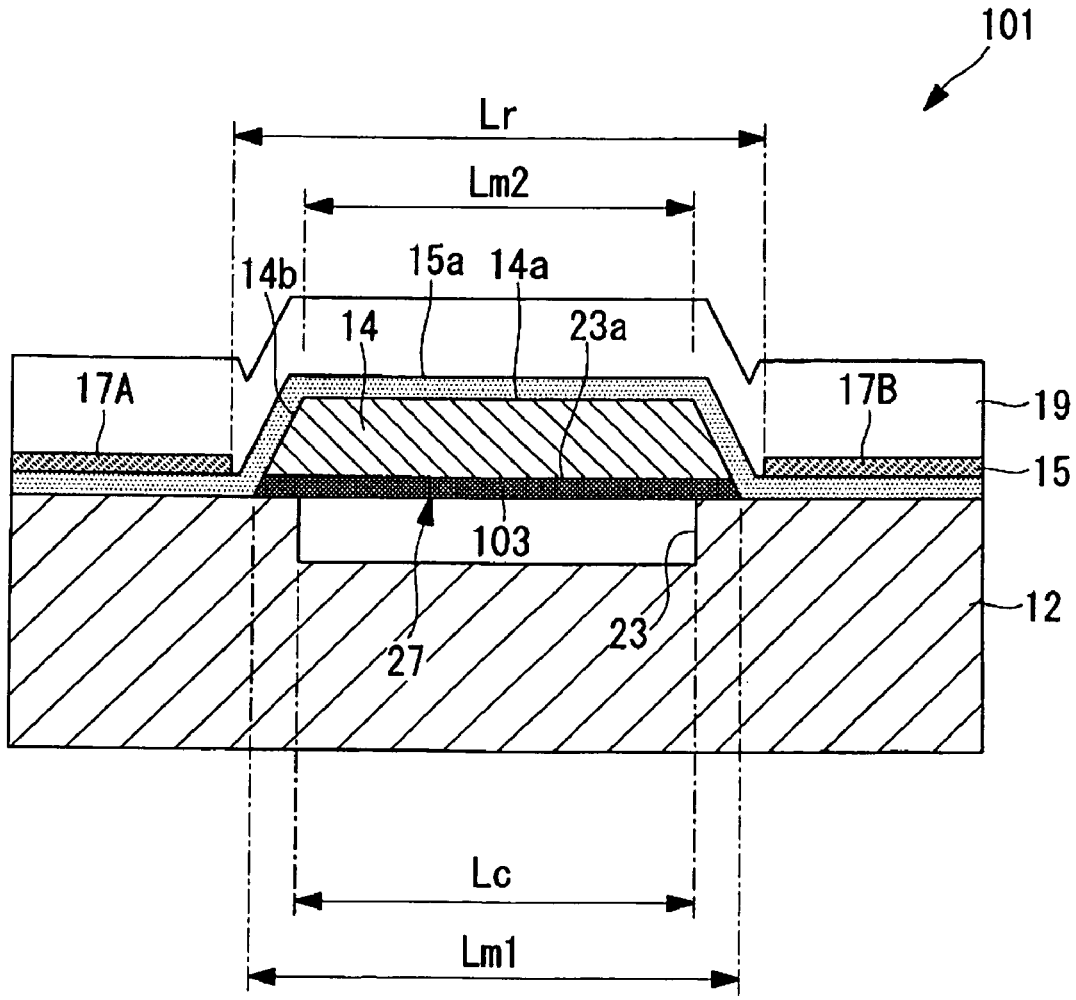
FIG. 19 is a vertical cross-sectional view of a thermal head according to a modified example of the second embodiment of the present invention.

For example, unlike the second embodiment in which the adhesive layer 103 is not formed in a region of the bonding surface of the upper substrate 14 opposed to the concave portion 23, as illustrated in FIG. 19, the adhesive layer 103 may be formed over an entire area of the bonding surface of the upper substrate 14. This eliminates the need for predetermined patterning in the adhesive layer forming step SB1, which may simplify the steps. Note that, a general resin material has thermal conductivity that is ⅓ of that of a glass material, and hence if the thickness of the adhesive layer 103 made of a resin is suppressed to ⅓ of the thickness of the upper substrate 14, an increase of thermal conductance of the heat storage layer may be suppressed to 10% as compared with the case where no adhesive layer 103 is formed in the region of the bonding surface of the upper substrate 14 opposed to the concave portion 23. Accordingly, heat insulating properties may not be significantly lowered.

What is claimed is:

1. A thermal head, comprising:

a support substrate having a concave portion having an opening portion formed in a surface of the support substrate;

an upper substrate bonded to the surface of the support substrate in a stacked state to close the opening portion, the upper substrate having an external dimension which is smaller than an external dimension of the support substrate and larger than an external dimension of the opening portion for closing the opening portion; and a heating resistor formed on a surface of the upper substrate in a position opposed to the concave portion.

2. A thermal head according to claim 1, wherein the upper substrate comprises:

a flat top surface formed on an opposite side of a bonding surface to the support substrate; and side surfaces inclined outward, from an outer periphery of the flat top surface, in a direction approaching the surface of the support substrate.

3. A thermal head according to claim 1, wherein the support substrate comprises step portions defined along a perimeter of the opening portion and protruding in a stacking direction.

4. A thermal head according to claim 1, further comprising a pair of electrodes connected to both ends of the heating resistor, wherein the upper substrate further comprises a convex portion formed in the surface of the upper substrate positioned between the pair of electrodes, the convex portion protruding toward a stacking direction with the heating resistor.

5. A thermal head according to claim 4, wherein the convex portion is formed inside a region opposed to the concave portion.

6. A thermal head according to claim 4, wherein the convex portion extends beyond a region opposed to the concave portion.

7. A thermal head according to claim 1, further comprising an adhesive layer disposed between the support substrate and the upper substrate, for adhering the support substrate and the upper substrate to each other.

8. A printer, comprising:

the thermal head according to claim 1; and a pressure mechanism for feeding a thermal recording medium while pressing the thermal recording medium against the heating resistor of the thermal head.

9. A manufacturing method for a thermal head, comprising:

a bonding step of bonding, in a stacked state to a flat plate-shaped support substrate including a concave portion opened in a surface of the flat plate-shaped support substrate, an upper substrate having an external dimension which is smaller than an external dimension of the flat plate-shaped support substrate and larger than an external dimension of the concave portion, so as to close the concave portion; and a resistor forming step of forming a heating resistor on a surface of the upper substrate bonded to the flat plate-shaped support substrate in the bonding step, in a position opposed to the concave portion.

10. A manufacturing method for a thermal head, comprising:

a bonding step of bonding a flat plate-shaped upper substrate in a stacked state to a flat plate-shaped support substrate including a concave portion opened in a surface of the flat plate-shaped support substrate, so as to close the concave portion;

a thinning step of thinning the plate-shaped upper substrate bonded to the flat plate-shaped support substrate;

a shaping step of removing portions outside a closing portion of the plate-shaped upper substrate for closing the concave portion while leaving the closing portion; and a resistor forming step of forming a heating resistor on a surface of the flat plate-shaped upper substrate thinned in the thinning step and shaped in the shaping step, in a position opposed to the concave portion.

11. A manufacturing method for a thermal head according to claim 10, wherein the shaping step comprises removing a region of the surface of the flat plate-shaped support substrate not covered by the flat plate-shaped upper substrate, to a given thickness.

12. A thermal head, comprising:

a support substrate having a concave portion having an opening that opens at a surface of the support substrate;

an upper substrate bonded to the surface of the support substrate and having an external dimension that is smaller than an external dimension of the support substrate and larger than the opening so that the upper substrate completely covers and closes the opening to form a hollow cavity portion between the support substrate and the upper substrate; and a heating resistor provided on a surface of the upper substrate in a position opposed to the concave portion.

13. A thermal head according to claim 12; wherein the upper substrate has a bonding surface bonded to the surface of the support substrate, a flat top surface opposite the bonding surface, and side surfaces inclined outward from an outer periphery of the flat top surface to the bonding surface.

14. A thermal head according to claim 12;

further comprising a pair of electrodes connected respectively to opposite ends of the heating resistor, wherein the upper substrate has a convex portion that is positioned between the pair of electrodes and that protrudes outward in a direction away from the support substrate, and wherein the heating resistor is provided on a surface of the convex portion.

15. A thermal head according to claim 14;

wherein the convex portion is formed inside a region opposed to the concave portion.

16. A thermal head according to claim 14;

wherein the convex portion extends beyond a region opposed to the concave portion.

17. A thermal head according to claim 12;

further comprising an adhesive disposed between the support substrate and the upper substrate for adhering the two substrates to each other.

18. A printer, comprising:

the thermal head according to claim 12; and a pressure mechanism for feeding a thermal recording medium while pressing the thermal recording medium against the heating resistor of the thermal head.

* * * * *